United States Patent [19]

Corder, Jr.

[11] Patent Number: 4,960,280

[45] Date of Patent: Oct. 2, 1990

[54] TRAINING DEVICE FOR GOLFERS

[76] Inventor: William O. Corder, Jr., 1206 Stonehurst Rd., Anderson, S.C. 29621

[21] Appl. No.: 354,994

[22] Filed: May 22, 1989

[51] Int. Cl.[5] ..... A63B 69/36

[52] U.S. Cl. ..... 273/189 R; 273/DIG. 30

[58] Field of Search ..... 273/189 R, 189 A, 190, 273/190 A, 190 B, 188 R, 183 B, DIG. 30

[56] References Cited

U.S. PATENT DOCUMENTS

| | | | |
|---|---|---|---|
| 1,699,219 | 1/1929 | Bemish et al. | 273/189 R |
| 2,808,267 | 10/1957 | Heaton | 273/189 R |
| 3,324,851 | 6/1967 | Posner | 273/189 R |
| 3,970,316 | 7/1976 | Westmoreland | 273/189 R |
| 4,691,924 | 9/1987 | Strong | 273/189 R |

*Primary Examiner*—George J. Marlo
*Attorney, Agent, or Firm*—Cort Flint

[57] ABSTRACT

The invention relates to a training device for improving a golfer's swing. More particularly, the invention relates to a training device for limiting the movement of both arms relative to the golfer's body. The device comprises a chest band and arm restraining bands that hold the golfer's arms close to the body and prevent their movement away from the body while at the same time permitting the movement of the arms across the body throughout the swing. Each arm band is connected to the chest band at two points, one of which is rearward of the arm, and the other of which is forward of the arm.

9 Claims, 4 Drawing Sheets

TRAINING DEVICE FOR GOLFERS

Cross-reference to related application

This application is related to serial number 218,279 to William O. Corder filed on July 13, 1988 entitled Releasable Golf-Swing Training Connector; now abandoned.

BACKGROUND OF THE INVENTION

The invention relates to a training device for improving a golfer's swing. More particularly, the invention relates to a training device for limiting the movement of both arms relative to the golfer's body.

The golf swing is governed by the laws of physics and geometry. The swing involves the geometry of a circle, the physics of rotation and momentum. Simply stated, the gold swing can be thought of as the clubhead rotating around the golfer along a tilted circle. The closer a golfer can come to forming a perfect circle with the clubhead, the better he will strike the ball. The only way a perfect circle can be formed by the golfer is by turning the upper torso around a fixed axis (the spine) and by maintaining a constant radius. The arms form the radius of the circle. By maintaining a close linkage between the upper part of both arms and upper torso, the golfer is free to simply turn the upper torso around the spine (axis) and automatically maintain a constant radius with their arms, thus forming a perfect circle.

There are other good reasons for a golfer to maintain this close linkage between the arms and upper torso in the golf swing. Simple laws of physics dictate that a golfer's arms will turn much faster when held close to the body. This is based on the conservation of angular momentum. Other authorities say that the arms themselves become lighter as they re brought in toward the body. The club can therefore be swung at a greater speed which translates into a greater distance the golfer can strike the ball. When the arms are held in the described position, the golfer is motivated to use the larger muscles in the upper torso and continue the rotation through Impact, rather than rely on the smaller muscles of the arms and hands which, again, translates into greater speed, direction, and distance.

Numerous devices have been proposed for training the golfer to have the correct swing by controlling the movement of one or both of the golfer's arms. For example, U.S. Pat. No. 3,970,316 discloses a golf swing restrictor which includes an elastic chest encircling band and an elastic arm encircling band which are joined together by stitching at an acute angle. U.S. Pat. No. 4,691,924 discloses a similar training device for restricting movement which includes a combination elastic/inelastic chest encircling band and an inelastic arm encircling band joined together by an inelastic web. This is different in that the chest and arm bands are not sewn together as in '316 patent. In addition, various improvements are said to be offered by the training device.

Both of these prior devices are designed to be used with only one arm. In fact, both of these devices completely restricts the movement of one arm and disallows a full swing. With this arrangement, the one arm which in many cases is the dominant arm of the golfer, will take over the swing and completely disrupt the circle of the golf swing, resulting in a poor shot. In addition, the one arm left free of the body weighs more which can slow the speed of the swing which resulting in a shorter distance the ball can be struck. The present invention provides a golf trainer that keeps both arms in close to the body, particularly through inpact, while allowing slight movement which is necessary in a real golf swing.

Another golf swing device is shown in U.S. Pat. No. 1,699,219. This device consists of three bands which encircle the upper torso of the golfer's body and two arms and attach with buckles. A traveler ring connects each arm encircling band to the chest encircling band with a guide strap to limit the upward movement of the arms while permitting a free swing of the arms across the body, particularly through impact. This harness allows too much movement by the arms and does not motivate the golfer to rotate his upper torso properly which can disrupt the circle. Because of this, a proper golf swing is not taught. As the arms are allowed too much movement, especially away form the body, the shape of the swing is distorted and power is lost.

In all of the above training devices, there are bands which encircle the arms in a confining and uncomfortable and restricted manner, two of which are composed of inelastic web, In addition these devices allow either too much or too little movement of the arms, both of which result in an incorrect swing.

SUMMARY OF THE INVENTION

It is the purpose of the herein described invention to provide an improved golf swing trainer that will keep both arms in their proper position close to the body throughout the golf swing while permitting slight flexibility and slight movement across the body which is necessary in the golf swing. The device provides for two elastic arm support bands, which encourage, but do not force, each arm to be held close to the body, particularly through impact.

It is another purpose of the invention to provide for arm and chest restraining bands that will provide the least amount of discomfort to the wearer. Some prior devices connect the arms at such an angle that a female's arms are likely to come across the bust line in an uncomfortable manner.

It is another object of this invention to provide elastic restricting bands that will allow some give in the swing and thus prevent injuries caused by sudden stresses against the arms, chest or back and allow slight movement which is necessary in the swing.

Another object of the present invention is to provide a golf swing training apparatus that does not permit freewheeling movement of the arms away from the body during impact.

Still another object of the present invention is to provides a golf swing trainer which may be manufactured inexpensively and is easy to use. One that constitutes easily discernable differences and is a distinct improvement over the training devices of the prior art.

Description of the Preferred Embodiment

The golf swing trainer is ideally constructed from elastic material with hook and latch type mating surfaces (velcro) used for those places where the straps need to be connected to each other (see 1,2,5, and 6). Of course, alternate materials may be used. Fabric or other material may be used for the support bands and other connections like buckles or hooks can be used in place of the velcro. While any demension straps that can reasonably be placed around a golfer's body may be used, the present invention ideally uses 2 inch wide bands. This, it is felt is less burdensome than a wider band which may cause discomfort for female wearers by being too constricting along the bustline.

Figure 2:
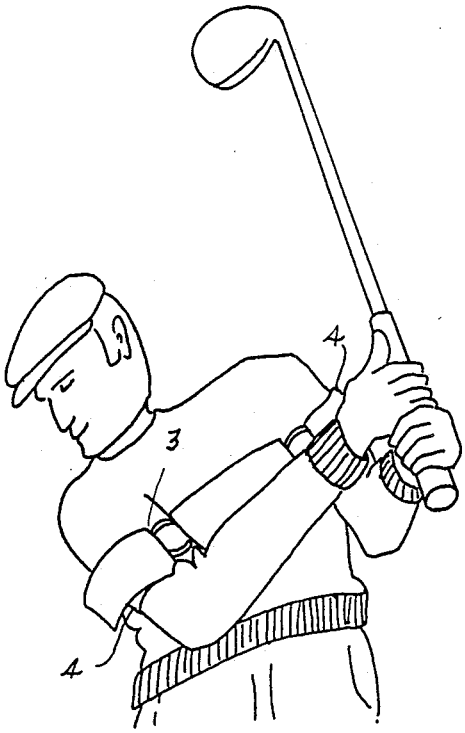
FIG. 2 shows a golfer wearing the apparatus during the followthrough.
Figure 1:
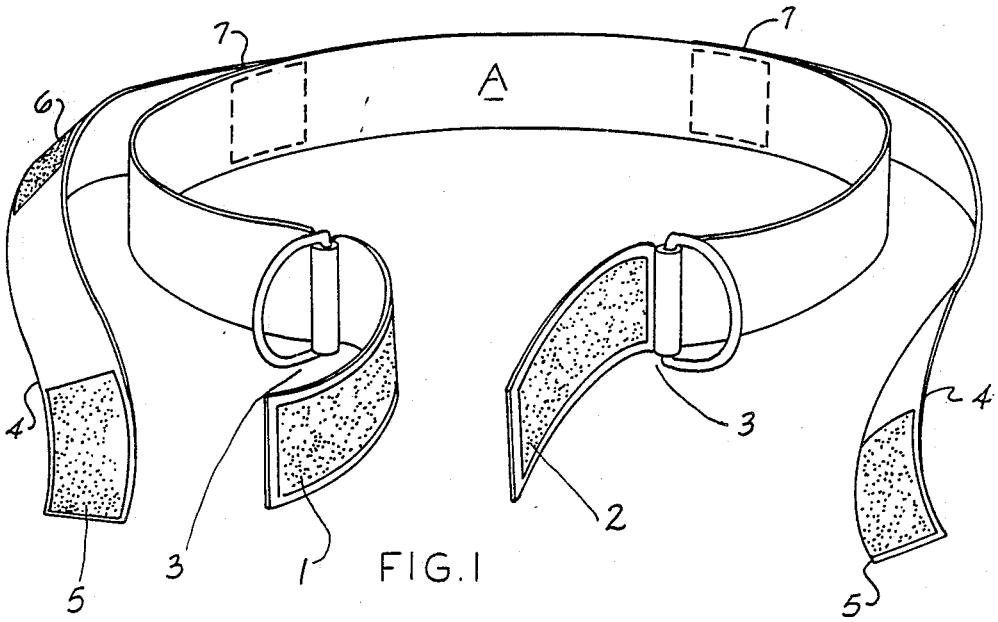
FIG. 1 illustrates the apparatus and its parts.
Figure 3:
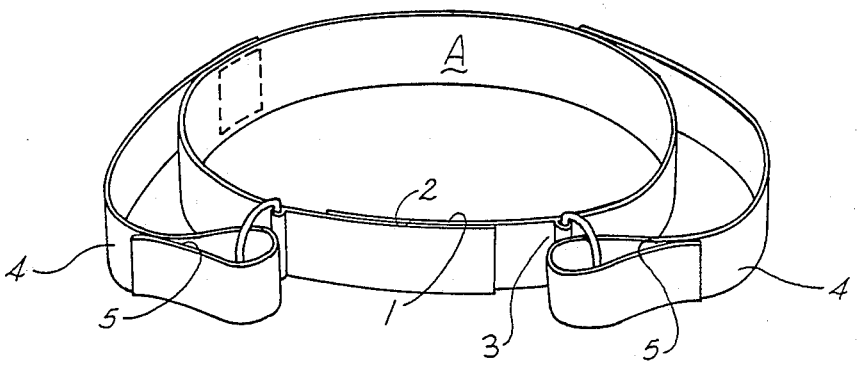
FIG. 3 shows the apparatus when the arm bands are attached in place, this is how the device is worn on the golfer.

The apparatus is constructed of three bands: the chest encircling band A, and the left and right arm support bands B and C (see FIG. 1). The chest encircling band goes around the user's chest and is in the form of a length of elastic fabric with mating portions at each end, (1 and 2). The mating portions can be at any position along the golfers chest, from below or above the bustline. The preferred embodiment joins at the front of the golfer, preferably around the sternum but it may be as far down as the waist.

"D" rings 8 are rigidly attached to the chest encircling band A, towards the front of the golfer, near the mating portion (3). Any strong material or device that would allow for adjustment could be used. These are placed toward the front of the golfer so that the arm support bands (4) may be looped through "D" rings 8 and then attached to the outside of the arm bands at 5 and 6 to hold, the arms with only slight movement permitted relative to the torso. The arm support bands are each rigidly attached at 7 to the chest band, near the golfer's side. Many constructions are possible here, it is perhaps cheaper to sew the arm band into the waist band, but any construction that provides for a rigid attachment of this end of the arm band to the chest band is possible.

Each armband B,C has a mating surface 5 at the free end of the arm band and one 6 near where it attaches to the waist band. This allows the golfer to place his arm at his side and loop the arm band through the "D" ring and attach the end of the arm band (5) to the other mating surface (6). This encourages the golfer to keep both arms linked to his side throughout the swing.

OPERATION

To attach the trainer, the chestband A should be fastened snugly around the chest. The chestband is the band with the two D rings on each end and two armbands sewn on the outside. To ensure correct positioning of the chestband, the golfer should place it around his back and attach the ends in front of him so that the two D rings are on the outside of the chestband and the two armbands are hanging behind his arms.

The golfer should pull each armband around each bicep area and pull the arm band through the D rings and attach them to the velcro on the outside of the armband. The armbands should be adjusted so that the arms are held snugly to the chest.

Figure 4:
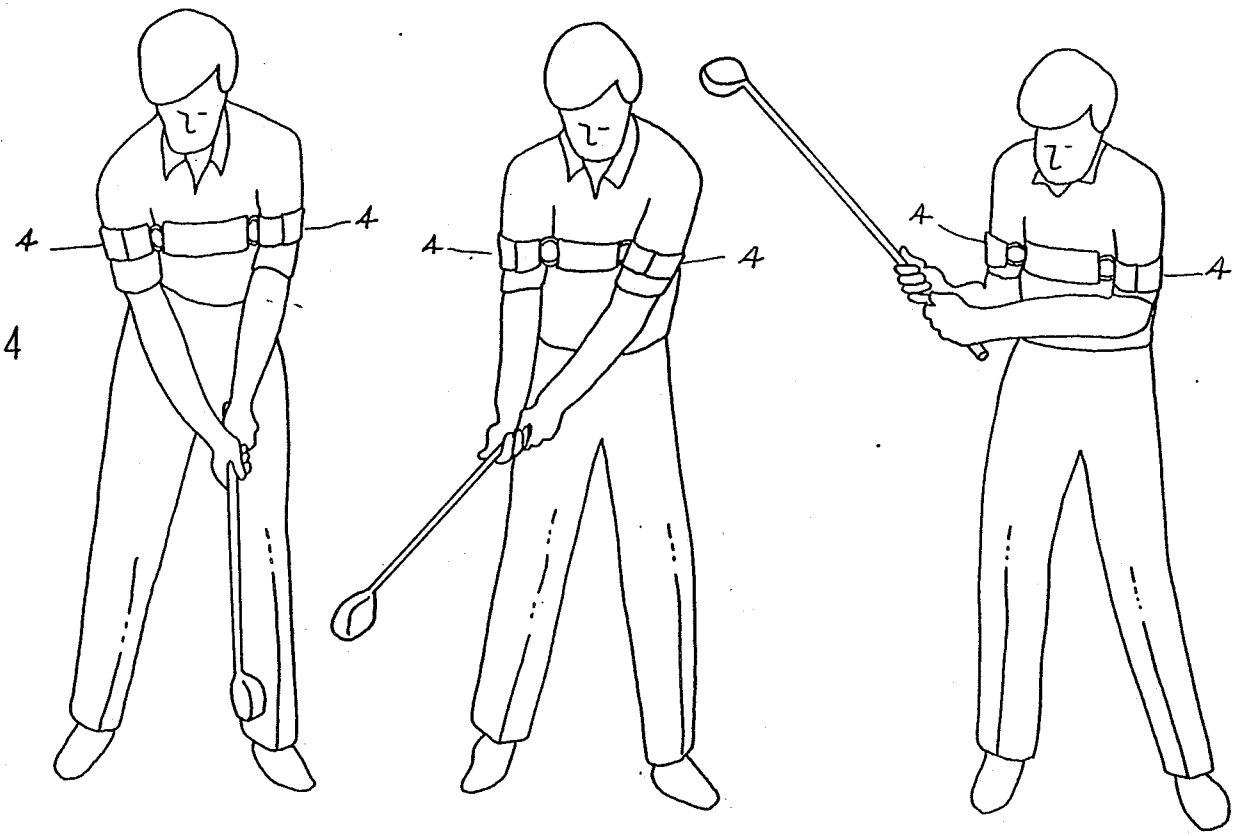
FIGS. 4 and 5 show the movement of the golfer's arms during the backswing and downswing when wearing the device.
Figure 5:
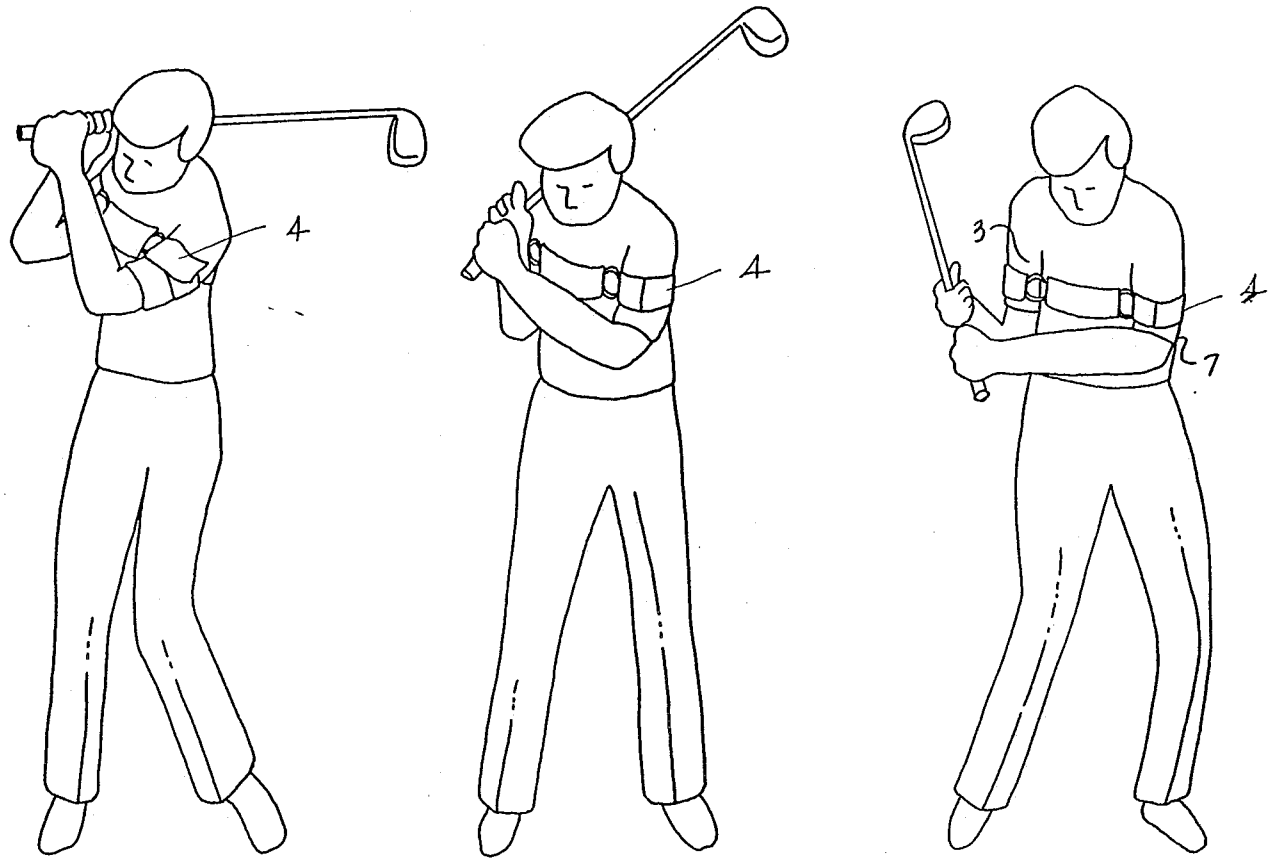

Now the golfer takes his normal golf swing. FIGS. 4 and 5 illustrate the backswing and downswing made with the golf trainer on. These drawings are intended to show how the golfer's arms move only slightly relative to the torso, and not across the body with the trainer on, distinctly different from those devices that encircle the arm completely and prevent this action of the arms with respect to the body. These prior devices only permit the movement of the arms insofar as the body is turning, the arms cannot move independently of the body.

It is common for the golfer to feel as though he is making a half swing at first but the new connected swing will produce increased power, accuracy and more consistent ball striking. By repeatedly swinging with the golf trainer on the golfer builds up "muscle memory". Essentially the golfer's mental and physical processes learn the new swing through repeated practice and eventually the new swing, with arms tucked in, becomes an instinctive movement.

I claim:

1. A golf swing training device for a golfer comprising:

a chest band for encircling an upper torso of said golfer;

attachmemt means for adjustably attaching said chest encircling band around said upper torso of said golfer;

a left arm restraining means carried on a left side of said chest band for restraining a left arm of said golfer;

a right arm restraining means carried on a right side of said chest band for restraining a right side of said golfer;

said left arm restraining mean including a strap having fastening means for fastening said strap near a first point rearward of said left arm and near a second point forward of said left arm so that said left arm of said golfer is held against said upper torso of said golfer with only slight movement of said left arm permitted relative to said upper torso generally between said first and second points; and said right arm restraining including a strap having fastening means for fastening said arm band means near a first point rearward of said right arm and near a second point forward of said right arm so that a right arm of said golfer is held against said upper torso of said golfer with only slight movement of said right arm permitted relative to said upper torso generally between said first and second points.

2. The device of claim 1 wherein said fastening means of said left and right arm restraining means includes a first fastening means securing said strap to said chest band at said first point rearwardly of said arms, a second fastening means which is adjustable and carried near said second point forwardly of said arms of said golfer for fastening a free end of said strap to said chest band.

3. The device of claim 2 wherein said second fastening means includes a first fastener carried on said chest band and a second fastener carried by said second end of said strap.

4. The device of claim 3 wherein said first fastener includes at least one ring carried by said chest band through which said free end of said strap passes for strapping said arm against said torso.

5. The device of claim 4 wherein said second fastener includes hook and latch fastening material carried near said free end and near an intermediate portion of said strap.

6. The device of claim 1 wherein said chest band and both said arm restraining means are made of an elastic material.

7. The device of claim 3 wherein said second fastener includes hook and latch fastening material carried near said free end and near an intermediate portion of said strap.

8. A golf swing training device for a golfer comprising:

a chest band for surrounding an upper torso of said golfer;

attachment means for attaching said chest encircling band about said upper torso;

said chest band having an interior side contacting said upper torso of said golfer and an exterior side facing away from said golfer;

a left arm restraining means carried by a left said of said chest band, said left arm restraining means having a first end secured to said chest band near a first point rearwardly of said left arm and a second end detachably affixed near a second point forwardly of said left arm so that said left arm restraining means straps said left arm against said exterior side of said chest band during the golf swing and permits only a slight movement of the golfer's arm between said first and second points during the swing; and a right arm restraining means carried by a right side of said chest band, said right arm restraining means having a first end secured to said chest band near a first point rearwardly of said right arm and a second end detachably affixed near a second point forwardly of said right arm so that said right arm restraining means straps said right arm against said exterior side of said chest band during the golf swing and permits only a slight movement of the golfer's arm between said first and second points during the swing.

9. The device of claim 8 including adjustable fastening means for adjustably fastening said second ends of said arm restraining means to said chest band including a first fastener carried by said chest band and a second fastener carried by said arm band means.

* * * * *